United States Patent [19]

Kitamura et al.

[11] Patent Number: 4,805,763

[45] Date of Patent: Feb. 21, 1989

[54] PASSENGER CONVEYOR GUIDE ARRANGEMENT

[75] Inventors: Shigeharu Kitamura; Kazuhiko Sugita, both of Inazawa, Japan

[73] Assignee: Mitsubishi Denki Kabushiki Kaisha, Japan

[21] Appl. No.: 66,198

[22] Filed: Jun. 25, 1987

[30] Foreign Application Priority Data

Jun. 30, 1986 [JP] Japan ..... 61-153408

[51] Int. Cl.[4] ..... B66B 23/12

[52] U.S. Cl. ..... 198/332; 403/348

[58] Field of Search ..... 198/332, 326, 838, 845; 403/348, 405.1, 406.1

[56] References Cited

U.S. PATENT DOCUMENTS

| | | | |
|---|---|---|---|
| 2,260,591 | 10/1941 | Thurston et al. | 198/332 |
| 2,839,165 | 6/1958 | De Gasso | 403/405.1 |
| 4,062,444 | 12/1977 | Nakov et al. | 198/838 X |
| 4,064,986 | 12/1977 | Bertovich | 198/326 |
| 4,249,649 | 2/1981 | Kraft | 198/332 |
| 4,653,708 | 3/1987 | Rich | 403/348 |

FOREIGN PATENT DOCUMENTS

| | | | |
|---|---|---|---|
| 3031910 | 8/1982 | Fed. Rep. of Germany | 403/405 |
| 57-126482 | 8/1982 | Japan . | |

*Primary Examiner*—Frank E. Werner
*Assistant Examiner*—Cheryl L. Gastineau
*Attorney, Agent, or Firm*—Leydig, Voit & Mayer

[57] ABSTRACT

A passenger conveyor guide arrangement comprises a guide rail which supports and guides step rollers mounted on the conveyor steps and a fastener which includes a nut and a bolt having a threaded shank and a substantially rectangular head for fastening the guide rail to the conveyor main frame. The guide rail includes a bottom guide portion for guiding a step roller tread and side guide portions vertically rising from the side edges of the bottom portion for guiding the roller sides. The bottom and the side guide portions together form a substantially U-shaped cross section. A side plate extends from the side guide portion at each side edge of the bottom guide portion in a direction substantially perpendicular to the bottom guide portion, and inturned portions extend from the lower end of the side plates in a direction substantially parallel to the bottom guide portion and each other to form a slit between the inner edges so as to engage the rectangular head of the bolt of the fastener.

9 Claims, 4 Drawing Sheets

PASSENGER CONVEYOR GUIDE ARRANGEMENT

BACKGROUND OF THE INVENTION

This invention relates to a passenger conveyor guide arrangement and, more particularly, to a passenger conveyor guide arrangement for guiding step rollers mounted to the side of steps of the passenger conveyor.

FIG. 1 is a schematic diagram illustrating a conventional passenger conveyor guide arrangement, FIG. 2 is a sectional view taken along line II—II of FIG. 1, and FIG. 3 is a sectional view taken along line III—III of FIG. 2. In these figures, a main frame 1 of the passenger conveyor extends between the upper landing and the lower landing. The passenger conveyor comprises an upper sprocket wheel 2 mounted on the upper end portion of the main frame 1 and driven by a drive unit 3, and a lower sprocket wheel 4 mounted on the lower end portion of the main frame 1. A step chain 5 is wound around and extended between the upper sprocket wheel 2 and the lower sprocket wheel 4 to form an endless loop and a plurality of steps 6 are connected to the step chain 5.

As shown in FIGS. 2 and 3, an axle 8 is connected to the step chain 5, and leading step rollers 7*a* and 7*b* are mounted on the opposite ends of this axle 8 extending transversely at the front portion of the step 6. The step 6 also has at the opposite sides of its rear portion trailing step rollers 9*a* and 9*b*. In order to guide and support the leading step rollers 7*a* and 7*b*, guide rails 10*a* and 10*b* of a U-shaped cross section are fixedly mounted to the conveyor main frame 1 by bolts 11*a* and 11*b*. Additional guide rails 12*a* and 12*b* of an L-shaped cross section for supporting and guiding the trailing step rollers 9*a* and 9*b* are also secured to the main frame 1 by welding.

With the passenger conveyor constructed as described above, when the drive unit 3 drives the sprocket wheel 2, the endless step chain 5 wound around the upper sprocket wheel 2 and the lower sprocket wheel 4 is driven together with the plurality of steps 6 connected to the step chain 5, and the steps 6 are guided and moved along the stairway defined by the guide rails 10*a*, 10*b* and 12*a*, 12*b*, so that the passengers on the steps can be conveyed along the stairway.

As is well known, each of the steps 6 are provided at the sides of their front portions with the leading step rollers 7*a* and 7*b* mounted on the axle 8 and at the sides of their rear portions with the trailing step rollers 9*a* and 9*b*, and they roll along and are guided by the guide rails 10*a*, 10*b* and 12*a*, 12*b*. Therefore, the steps 6 are moved and guided along the guide rails 10*a*, 10*b* and 12*a*, 12*b*.

However, in the conventional passenger conveyor guide arrangement as described above, the guide rails 10*a* and 10*b* are secured to the frame by the bolts 11*a* and 11*b*. The bolts 11*a* and 11*b* are welded at one end thereof to the bottom surfaces of the bight portions of the guide rails 10*a* and 10*b*, and the other end extends through holes in a horizontal member of the main frame 1 and are fastened thereto by nuts. Therefore, during the welding operation, the guide rails 10*a* and 10*b* are subjected to weld distortions, reducing the dimensional accuracy of the guide rails 10*a* and 10*b*.

In order to solve the above-discussed problem, an arrangement as shown in FIGS. 4 and 5 has been proposed in Japanese Utility Model Laid-Open No. 57-126482, for example. According to this arrangement, U-shaped clips 14 which engage at the tips of the legs of the U with the side walls of the guide rail 13 are used. Each U-shaped clip 14 has a threaded hole 15 in its bight portion through which the threaded end of the bolt 17 is engaged. The bolt 17 extends through the U-shaped bracket 16 welded to a suitable member of the main frame 1. When the bolt 17 is tightened the clip 14 is pulled toward the bracket 16 to firmly press the guide rail 13 against the bracket 16, thereby securing the guide rail 13 to the member of the main frame 1.

However, even with the above arrangement, the clip 16 can be plastically bent when the bolt 17 is tightened and the bolt 17 can sometimes loosen and then drop off. Also, since the tension of the bolt 17 compresses the side walls of the guide rail 13, the side walls of the guide rail 13 can collapse, decreasing the dimensional accuracy, and also forming irregular bumps which provide shocks or shakes to the step guide rollers, resulting in an uncomfortable ride in the passenger conveyor.

SUMMARY OF THE INVENTION

Accordingly, an object of the present invention is to provide a passenger conveyor guide arrangement in which the dimensional accuracy of the guide rails is not reduced.

Another object of the present invention is to provide a passenger conveyor guide arrangement in which a comfortable ride is not degraded.

Still another object of the present invention is to provide a passenger conveyor guide arrangement that is safe and reliable.

With the above objects in view, a passenger conveyor guide arrangement for a passenger conveyor including a main frame of the present invention comprises a guide rail for supporting and guiding step rollers mounted on passenger conveyor steps, and fastening means for fixedly fastening the guide rail to the step main frame. The guide rail comprises a bottom guide surface for engaging a tread of the step roller in a rolling contact relationship, side guide surfaces rising from opposite sides of the flat surface for engaging sides of the step roller for limiting the lateral movement of the step roller, the bottom guide surface and the side guide surfaces together forming a substantially U-shaped cross section, side plates extending from the opposite sides of the bottom guide surface in the direction substantially opposite to the direction of extension of the side guide surfaces, and inturned portions extending from the side plates to each other with a slit formed between inner edges of the in-turned portions. The fastening means comprises a bolt and a nut, and the bolt has a threaded shank and a substantially rectangular head engageable with the in-turned portions of the guide rail.

BRIEF DESCRIPTION OF THE DRAWINGS

The present invention will become more readily apparent from the following detailed description of the preferred embodiment of the present invention taken in conjunction with the accompanying drawings, in which.

DETAILED DESCRIPTION OF THE PREFERRED EMBODIMENTS

Figure 1:
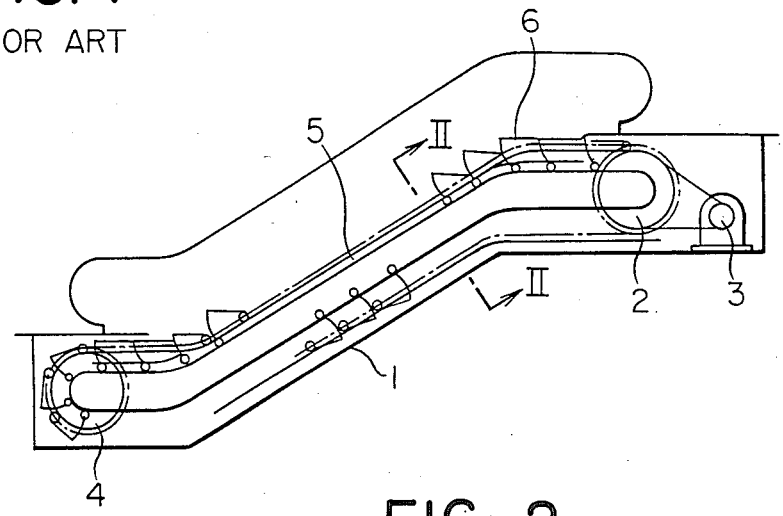
FIG. 1 PRIOR ART
FIG. 1 is a schematic diagram illustrating a conventional passenger conveyor.
Figure 2:
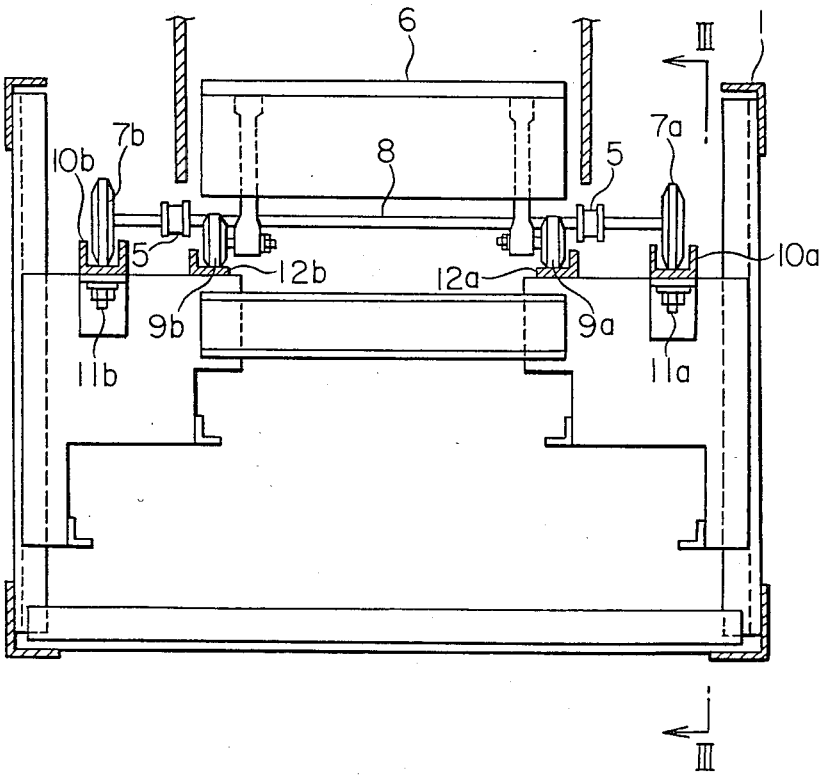
FIG. 2 PRIOR ART
FIG. 2 is a sectional view taken along line II—II of FIG. 1.
Figure 3:
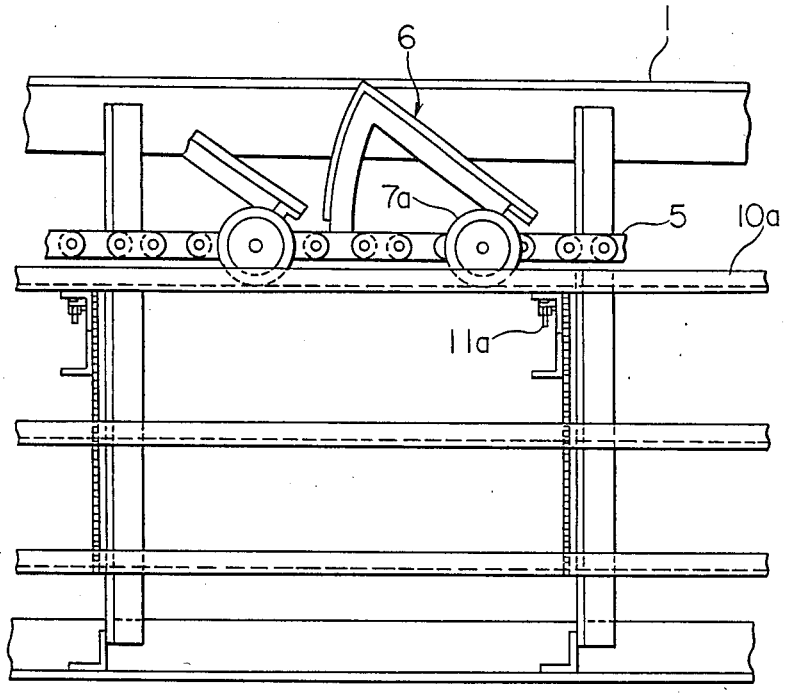
FIG. 3 PRIOR ART
FIG. 3 is a sectional view taken along line III—III of FIG. 2.
Figure 4:
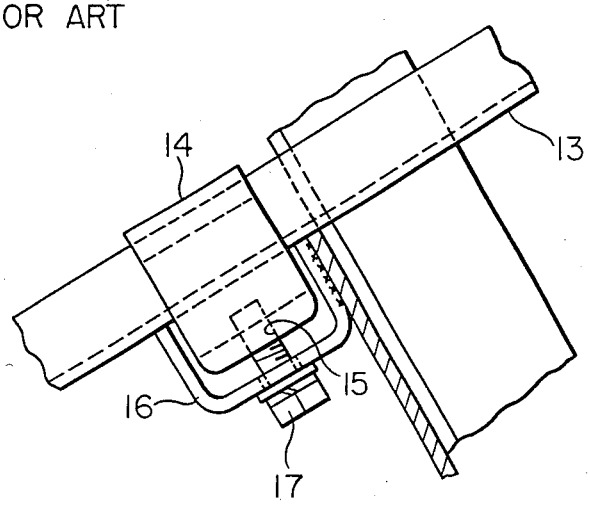
FIG. 4 PRIOR ART
FIG. 4 is a side view of a conventional arrangement for mounting the step roller guide rail to the main frame.
Figure 5:
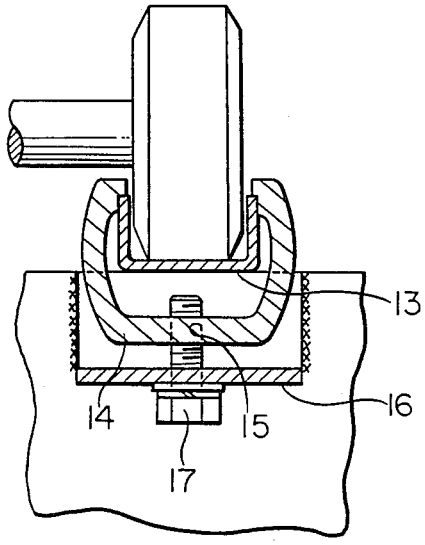
FIG. 5 PRIOR ART
FIG. 5 is a cross sectional view taken along line V—V of FIG. 4 showing the conventional mounting arrangement.
Figure 6:
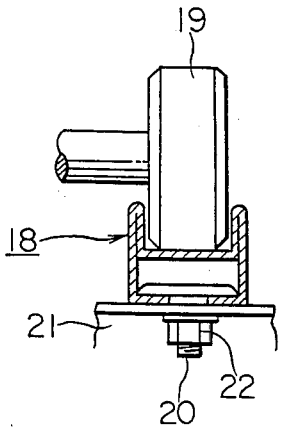
FIG. 6 is a front view illustrating a passenger conveyor guide arrangement of the present invention.
Figure 7:
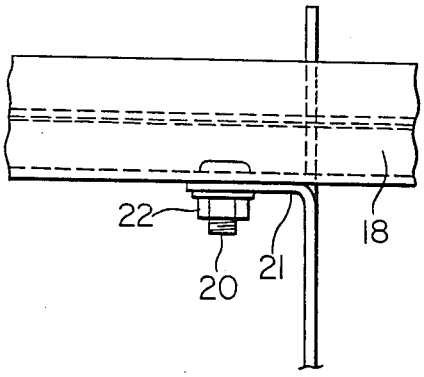
FIG. 7 is a side view of the passenger conveyor guide arrangement shown in FIG. 6.

FIGS. 6 and 7 illustrate one embodiment of the passenger conveyor guide arrangement constructed in accordance with the present invention. The guide arrangement comprises a guide rail 18 for guiding step roller 19 mounted to the side portions of passenger conveyor steps (not shown in FIGS. 6 and 7) and a fastener 20 for fixedly fastening the guide rail 18 to a mounting member 21 of the passenger conveyor main frame.

Figure 8:
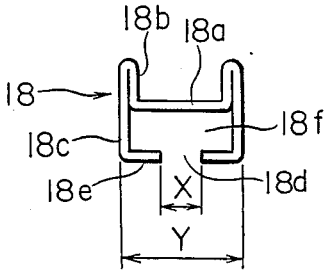
FIG. 8 is front view showing the guide rail shown in FIG. 6.

As best shown in FIG. 8, the guide rail 18 is an elongated member manufactured by bending an elongated flat rectangular steel sheet. The guide rail 18 comprises a flat bottom portion **18*a* defining a guide surface for engaging a tread of the step roller 19 in a rolling contact relationship. The guide rail 18 also comprises two side wall portions 18*b* defining side guide surfaces. The side wall portions 18*b* are bent at about 90° with respect to the flat bottom portion 18*a* at opposite side edges of the bottom portion 18*a* so that a substantially U-shaped cross section is formed. The side wall portions 18*b* engage sides of the step roller 19 when the step roller 19 is laterally moved and limit the lateral movement of the step roller 19** beyond a predetermined distance.

The guide rail 18 of the present invention further comprises side plates or bent-down portions **18*c* bent at about 180° at the upper edges of the side wall portions 18*b* to extend downwards along the outer surface of the side wall portions 18*b* and further by a predetermined distance beyond the lower edges of the side wall portion 18*b* sufficient to define a space between the bent-down portions 18*c* and the lower surface of the bottom portion 18*a* for accomodating a head of the fastener bolt 20. The space thus defined has a width Y. These bent-down portions 18*c* may be referred to as side plates. The lower edges of the bent-down portions 18*c* are bent inwardly at about 90° to form in-turned portions 18*e*. The in-turned portions 18*e* have inner edges separated to define a slit 18*d*** of a width X therebetween.

Figure 9:
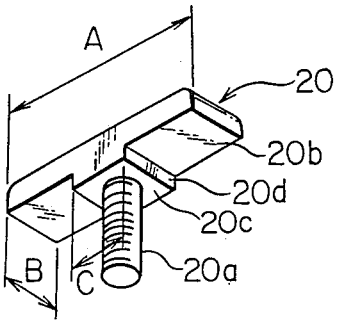
FIG. 9 is a plan view of the bolt shown in FIG. 6.
Figure 10:
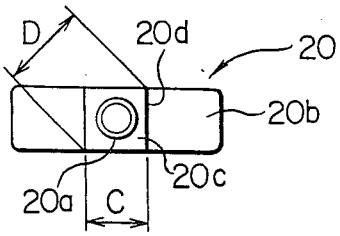
FIG. 10 is a perspective view of the bolt shown in FIG. 9.

The fastener of the illustrated embodiment comprises a bolt 20 as shown in FIGS. 9 and 10 and a nut 22. The bolt 20 has a threaded shank **20*a* and a substantially rectangular head 20*b* engageable with the in-turned portions 18*e* of the guide rail 18. The rectangular head 20*b* has a central thick portion 20*c* with a shoulder portion or a step 20*d* formed therebetween. The height of the step 20*d* is equal to or smaller than the thickness of the in-turned portions 18*e* of the guide rail 18. The length A of the head 20*b* is smaller than the width Y of the space 18*f* (the distance between the inner surface of the bent-down portions 18*c* of the guide rail 18) and larger than the width X of the slit 18*d* (the distance between the inner edges of the in-turned portions 18*e*). The width B of the head 20*b* is smaller than the width X of the slit 18*d* of the guide rail 18. The thick central portion 20*c* has the same width B as the head 20*b*, a length C which is equal to or smaller than the width X of the slit 18*d* of the guide rail 18**, and the diagonal dimension D which is larger than the width X. In summary, the relationships between various dimensions described above can be expressed as follows:

$$X<A<Y,\ B<X,\ C\leqq X,\ \text{and}\ D>X$$

Thus, the head **20*b* of the bolt 20 can be passed through the slit 18*d* of the guide rail 18 with the rectangular head 20*b* oriented in parallel to the direction of extension of the slit 18*d*. Therefore, the bolts 20 may first be inserted into the holes formed in the mounting member 21 of the passenger conveyor main frame with the nuts 22 loosely fit on the bolt. Then, the guide rail 18 can be placed over the loosely mounted bolts 20 with the slit 18*d* of the guide rail 18 passed over the head 20*b*. The head 20*b* can then be rotated about 90° within the space 18*f* of the guide rail 18 so that the shoulder 20*d* of the thick portion 20*c* of the head 20*b* fits against the inner edges of the in-turned portions 18*e* of the guide rail 18. When the thick portion 20*c* fits within the slit 18*d*, the head 30*b* can no longer be rotated about the axis of the shank 20*a*. After the guide rail 18 is accurately ed, the nuts 22 on the bolts 20 are tightened to ensure that the heads 20*b* firmly hold down the in-turned portions 18*e* of the guide rail 18 against the mounting member 21** of the passenger conveyor main frame.

As apparent from the forgoing description of the passenger conveyor guide arrangement of the present invention, since no welding is required during assembly of the arrangement, no welding distortion occurs and dimensional accuracy of the guide rail is increased. Also, since only the in-turned portions **18*e* of the guide rail 18 are firmly held by the bolts 20 and no external force is applied to the guide portions 18*a* and 18*b* which contribute to define the step roller guiding surface, the dimensional accuracy of the guiding portions 18*a* and 18*b* of the guide rail 18 can be maintained. Further, since the fastener bolts can be attached to the main frame before the guide rail 18** is placed on the main frame, the assembly and therefore the installation of the passenger conveyor is simple and easy. Also, the number of parts is reduced as compared to the conventional design.

What is claimed is:

1. A guide arrangement of a passenger conveyor comprising:

a guide rail which supports and guides step rollers mounted on passenger conveyor steps; and a fastener including a nut and a bolt having a threaded shank and a substantially rectangular head which fixedly fastens said guide rail to a conveyor main frame;

said guide rail including:

first means providing a bottom guide surface for engaging a tread of the step rollers in a rolling contact relationship;

second means providing side guide surfaces rising from opposite sides of said bottom guide surface for engaging sides of the step rollers to limit lateral movement of the step rollers, said bottom guide surface and said side guide surfaces together forming a substantially U-shaped cross section;

side plates extending from said side guide surfaces at opposite sides of said bottom guide surface in a direction substantially perpendicular to said bottom guide surface; and in-turned portions extending from said side plates in a direction substantially parallel to said bottom guide surface and towards each other to form a slit between inner edges of said in-turned portions through which said rectangular head of said bolt passes in a first orientation, and said bolt being rotatable from the first orientation to a second orientation at which the inner edges of said in-turned portions engage a portion of said rectangular head of said bolt and lock said bolt against rotation as said nut is turned on said threaded shank and fastens said guide rail on said conveyor frame.

2. A passenger conveyor guide arrangement as claimed in claim 1 wherein said guide rail is an elongated member manufactured by bending an elongated flat rectangular sheet material.

3. A passenger conveyor guide arrangement as claimed in claim 1 wherein:

said first means includes a flat bottom portion defining said bottom guide surface;

said second means includes two side wall portions defining said side guide surfaces;

said side plates extend downwards along outer surfaces of said side wall portions for a predetermined distance beyond lower edges of said side wall portions to provide a space between said in-turned portions and said flat bottom portion so as to sufficiently accommodate said rectangular head of said bolt; and said rectangular head includes a central portion and two side portions, said central portion being thicker than said side portions to support said threaded shank.

4. A passenger conveyor guide arrangement as claimed in claim 3 wherein said rectangular head of said bolt has a length smaller than the width of said space of said guide rail and larger than the width of said slit of said guide rail and a width smaller than the width of said slit of said guide rail, and wherein said central portion of said rectangular head has a width equal to the width of said rectangular head, a length at most equal to the width of said slit of said guide rail, and a diagonal dimension larger than the width of said rectangular head.

5. A passenger conveyor as claimed in claim 3 wherein said central portion of said rectangular head has a height at most equal to the thickness of said in-turned portions of said guide rail.

6. A passenger conveyor as claimed in claim 3 wherein said bolt is inserted to extend through a through-hole in the main frame.

7. A passenger conveyor as claimed in claim 6 wherein the width of said through-hole is smaller than the diagonal dimension of said central portion of said rectangular head.

8. A passenger conveyor as claimed in claim 6 further comprising a mounting member which supports said guide rail on the conveyor main frame and wherein the width of said through-hole is substantially equal to the length of said central portion, and said central portion has a thickness substantially equal to a sum of the thickness of said in-turned portions of said guide rail and the thickness of said mounting member.

9. A guide arrangement for a passenger conveyor comprising:

a guide rail which supports and guide step rollers mounted on passengers conveyor steps; and fastening means including a bolt having a threaded shank and a substantially rectangular head for fixedly fastening said guide rail to a conveyor main frame;

said guide rail including:

first means providing a bottom guide surface for engaging a tread of the step rollers in a rolling contact relationship;

second means providing side guide surfaces rising from opposite sides of said bottom guide surface for engaging sides of the step rollers to limit lateral movement of the step rollers, said bottom guide surface and said side guide together forming a substantially U-shaped cross section;

side plates extending from said side guide surfaces at opposite sides of said bottom guide surface in a direction substantially perpendicular to said bottom guide surface; and in-turned portions extending from said side plates in a direction substantially parallel to said bottom guide surface and towards each other to form a slit between inner edges of said in-turned portions, which inner edges engage said rectangular head of said bolt of said fastening means, said rectangular shaped head including a rectangular shaped central portion and two side portions, said central portion being thicker than said side portions to support said thread shank, said extra thickness being on the side of the threaded shank whereby the thickened portion of the head is seated within the slit, thereby locking the bolt against rotation.

* * * * *